US009820601B2

(12) United States Patent
Egami

(10) Patent No.: US 9,820,601 B2
(45) Date of Patent: Nov. 21, 2017

(54) SOLAR SHADING DEVICE

(71) Applicant: TACHIKAWA CORPORATION, Tokyo (JP)

(72) Inventor: Tatsuya Egami, Tokyo (JP)

(73) Assignee: TACHIKAWA CORPORATION, Tokyo (JP)

( * ) Notice: Subject to any disclaimer, the term of this patent is extended or adjusted under 35 U.S.C. 154(b) by 0 days.

(21) Appl. No.: 14/917,994

(22) PCT Filed: Sep. 9, 2014

(86) PCT No.: PCT/JP2014/073776
§ 371 (c)(1),
(2) Date: Apr. 7, 2016

(87) PCT Pub. No.: WO2015/037575
PCT Pub. Date: Mar. 19, 2015

(65) Prior Publication Data

US 2016/0220055 A1 Aug. 4, 2016

(30) Foreign Application Priority Data

Sep. 12, 2013 (JP) ..... 2013-189899

(51) Int. Cl.
*E06B 9/36* (2006.01)
*A47H 5/02* (2006.01)

(52) U.S. Cl.
CPC ..... *A47H 5/02* (2013.01); *E06B 9/36* (2013.01); *E06B 9/364* (2013.01); *E06B 9/368* (2013.01); *A47H 2005/025* (2013.01)

(58) Field of Classification Search
CPC ..... A47H 5/02; A47H 2005/025; E06B 9/36; E06B 9/364
(Continued)

(56) References Cited

U.S. PATENT DOCUMENTS 3,297,078 A * 1/1967 Seizo ..... A47H 5/0325 160/126
4,072,404 A * 2/1978 Brown ..... G03B 21/58 160/310
(Continued)

FOREIGN PATENT DOCUMENTS

EP 1679422 A1 7/2006
JP 62-120876 U 7/1987
(Continued)

OTHER PUBLICATIONS

International Search Report dated Nov. 4, 2014 from corresponding International Application No. PCT/JP2014/073776; 3 pgs.
(Continued)

*Primary Examiner* — Katherine Mitchell
*Assistant Examiner* — Abe Massad
(74) *Attorney, Agent, or Firm* — Maier & Maier, PLLC

(57) ABSTRACT

A solar shading device includes a head rail that slidably supports leading runners having fabric curtains attached thereto, a carrying mechanism that includes a carrying pulley coupled to the leading runners through a belt and carries the leading runners along the head rail on the basis of the rotation of the carrying pulley, a manual drive unit that includes a first shaft coupled to the carrying pulley and serving as a drive shaft, and a suspension part having the manual drive unit suspended therefrom with the carrying pulley and the first shaft coupled together. Further, with the manual drive unit detached from the suspension part, the suspension part allows an electric drive unit to be suspended therefrom with the carrying pulley and a second shaft coupled together, the electric drive unit including the second shaft as a drive shaft for driving the carrying pulley.

5 Claims, 8 Drawing Sheets

(58) Field of Classification Search
USPC ..... 160/331, 168.1 P, 310, 321; 74/625
See application file for complete search history.

(56) References Cited

U.S. PATENT DOCUMENTS

| | | | | |
|---|---|---|---|---|
| 4,775,039 | A | 10/1988 | Sunakawa | |
| 4,844,140 | A * | 7/1989 | Jones | E06B 9/174 160/310 |
| 5,611,386 | A * | 3/1997 | Wang | A47H 5/0325 160/168.1 P |
| 6,076,588 | A | 6/2000 | Swiszcz et al. | |
| 6,076,592 | A | 6/2000 | Grutzner | |
| 6,112,798 | A * | 9/2000 | Cheng | E06B 9/36 160/174 V |
| 6,148,893 | A * | 11/2000 | Cadorette | E06B 9/32 160/176.1 P |
| 6,749,000 | B2 * | 6/2004 | Bohlen | E06B 9/322 160/178.1 R |
| 6,994,145 | B2 * | 2/2006 | Killo | A47H 1/04 160/331 |
| 7,128,122 | B2 * | 10/2006 | Lin | E06B 9/324 160/168.1 P |
| 7,216,688 | B2 * | 5/2007 | Huang | E06B 9/36 160/168.1 R |
| 7,703,501 | B2 * | 4/2010 | ter Braak | A47H 5/0325 160/331 |
| 8,336,598 | B1 * | 12/2012 | Chang | E06B 9/56 160/177 V |
| 2006/0151130 | A1 | 7/2006 | Ulatowski | |
| 2012/0090797 | A1 * | 4/2012 | Mullet | E06B 9/322 160/331 |

FOREIGN PATENT DOCUMENTS

| | | | |
|---|---|---|---|
| JP | 62-145581 | U | 9/1987 |
| JP | H11-151158 | A | 6/1999 |
| JP | 2005-230289 | A | 9/2005 |
| JP | 2013-172928 | A | 9/2013 |

OTHER PUBLICATIONS

Extended European Search Report dated Aug. 12, 2016, including the Supplementary European Search Report and the European Search Opinion, in connection with corresponding EP Application No. 14843800.5 (7 pgs.).

* cited by examiner

SOLAR SHADING DEVICE

A technology of the present disclosure relates to a solar shading device.

BACKGROUND ART

There have been known sunlight open/close apparatuses including a carrying mechanism that carries, along a head rail, runners having a sunlight shielding member, such as a curtain, attached thereto. Such a carrying mechanism includes a carrying pulley that rotates in directions corresponding to open/close operations of the user, and carries the runners on the basis of the rotation of the carrying pulley. The modes of driving a carrying mechanism are broadly classified into manual drive modes in which a carrying pulley is rotated by manually operating a manual operation cord suspended from an end of a head rail and electric drive modes in which a carrying pulley is rotated using the output of a motor.

For example, a solar shading device disclosed in Patent Literature 1 includes a carrying mechanism whose drive mode can be selected between manual drive mode and electric drive mode. In this carrying mechanism, a carrying pulley and a drive pulley are coupled through an endless wire, and the drive pulley is coupled to the output shaft of a motor through an electromagnetic clutch. When the endless wire is operated manually with the electromagnetic clutch disengaged, the carrying mechanism is driven manually; when the motor is driven with the electromagnetic clutch engaged, the carrying mechanism is driven electrically.

CITATION LIST

[Patent Literature 1] Japanese Unexamined Utility Model Registration Application Publication No. 62-120876

SUMMARY OF INVENTION

Technical Problem

Whether the carrying mechanism is driven manually or electrically, the solar shading device disclosed in Patent Literature 1 always includes the manual operation cord, which couples the carrying pulley and drive pulley, and the motor, which is the driving source of the carrying pulley. In this case, the motor is an unnecessary apparatus element for a user who wants to drive the carrying mechanism manually; the manual operation cord is an unnecessary apparatus element for a user who wants to drive the carrying mechanism electrically. For this reason, solar shading devices whose carrying mechanism drive mode is selected between manual and electric drive modes are required to change the apparatus configuration to that suitable for the drive mode desired by the user.

An object of the technology of the present disclosure is to provide a solar shading device capable of changing the apparatus configuration to that suitable for a carrying mechanism drive mode desired by the user.

Solution to Problem

To solve the above problem, a solar shading device includes a head rail configured to slidably support a runner to which a sunlight shielding member is attached, a carrying mechanism including a carrying pulley coupled to the runner through a carrying member, the carrying mechanism being configured to carry the runner along the head rail on the basis of rotation of the carrying pulley, a first operation unit including a first shaft, the first shaft being coupled to the carrying pulley and serving as a drive shaft, and a suspension part having the first operation unit suspended therefrom with the carrying pulley and the first shaft coupled together. The suspension part has the first operation unit detachably suspended therefrom. With the first operation unit detached from the suspension part, the suspension part allows a second operation unit to be suspended therefrom with the carrying pulley and a second shaft coupled together, the second operation unit including the second shaft as a drive shaft for driving the carrying pulley. One of the first operation unit and the second operation unit is a manual drive mechanism including a manual operation cord and causing a drive shaft to be rotated manually. The other of the first operation unit and the second operation unit is an electric drive mechanism including a power supply cord and causing a drive shaft to be rotated electrically.

In the solar shading device, the carrying pulley preferably has a shaft insertion hole through which the drive shaft is passed along a vertical direction, and when the first operation unit is rotated about the drive shaft from a suspension position to an attachment/detachment position with the drive shaft passed through the shaft insertion hole, suspension of the first operation unit from the suspension part is preferably released.

In the solar shading device, the first and second operation units preferably each include a unit cap suspended from the suspension part, a stopper capable of protruding from and retracting into an upper surface of the unit cap, and an energizing spring configured to energize the stopper upward; the suspension part preferably includes a suspension support part from which the unit cap is suspended and a pressing part configured to press the stopper so that the stopper retracts into the unit cap and having an engaging port into which the stopper is engaged when the operation unit lies in the suspension position; and with the stopper engaged in the engaging port, rotation of the operation unit about the drive shaft is preferably prevented.

In the solar shading device, the first and second shafts are preferably formed with identical rectangular sections.

In the solar shading device, the head rail preferably includes multiple head rails which are each provided with the carrying mechanism; the first operation unit is preferably attached to the carrying mechanism on one of the head rails; and the second operation unit is preferably attached to the carrying mechanism on another of the head rails.

Advantageous Effects of the Invention

According to the solar shading device of the present disclosure, when selecting the carrying mechanism drive mode, the apparatus configuration can be changed to that suitable for the selected carrying mechanism drive mode.

DESCRIPTION OF EMBODIMENTS

Referring now to FIGS. 1 to 15, an embodiment of a solar shading device of the present disclosure will be described.

Figure 1:
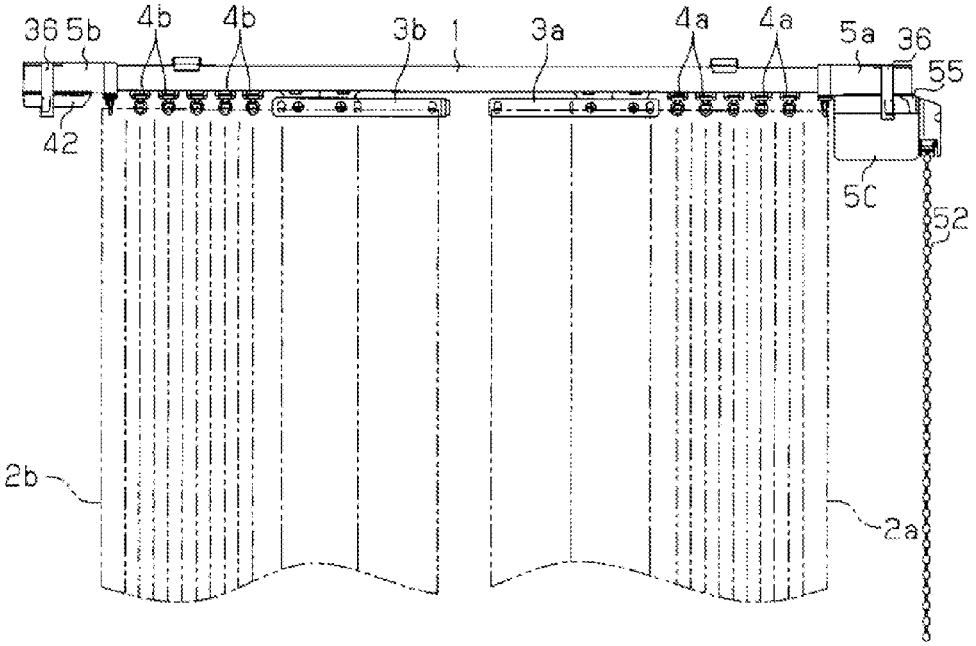
FIG. 1 is a diagram showing a schematic configuration of an embodiment of a solar shading device of the present disclosure and is a diagram showing a schematic configuration of a solar shading device in which a manual drive unit is attached to a carrying mechanism.

As shown in FIG. 1, in a double-sided solar shading device, fabric curtains 2*a*, 2*b* serving as sunlight shielding members are drawn out from both ends of a curtain rail 1 toward the center thereof, or the fabric curtains 2*a*, 2*b* are drawn back from the center of the curtain rail 1 toward the both ends and folded up.

A pair of leading runners 3*a*, 3*b* are movably supported by the curtain rail 1; many runners 4*a* are movably supported between the leading runner 3*a* and the right end of the curtain rail 1; and many runners 4*b* are movably supported by the curtain rail 1 between the leading runner 3*b* and the left end of the curtain rail 1. One of the fabric curtains, 2*a*, is suspended from and supported by the leading runner 3*a* and runners 4*a*, and the other fabric curtain, 2*b*, is suspended from and supported by the leading runner 3*b* and runners 4*b*. Carrying mechanisms 5*a*, 5*b* are attached to the right end and left end, respectively, of the curtain rail 1. The carrying mechanisms 5*a*, 5*b* are provided with endless carrying belts (to be discussed later) that move within the curtain rail 1.

As shown in FIG. 1, if the user selects manual mode to drive the carrying mechanisms 5*a*, 5*b*, the user suspends a manual drive unit 50 from the carrying mechanism 5*a* at the right end of the curtain rail 1 in such a manner that the manual drive unit 50 is supported by the carrying mechanism 5*a*. The manual drive unit 50 is a manual drive mechanism detachable from the carrying mechanism 5*a*. A manual operation cord 52 is suspended from the right end of the manual drive unit 50. When the user operates the manual operation cord 52, the manual drive unit 50 moves the leading runners 3*a*, 3*b* in a direction corresponding to the operation.

Figure 2:
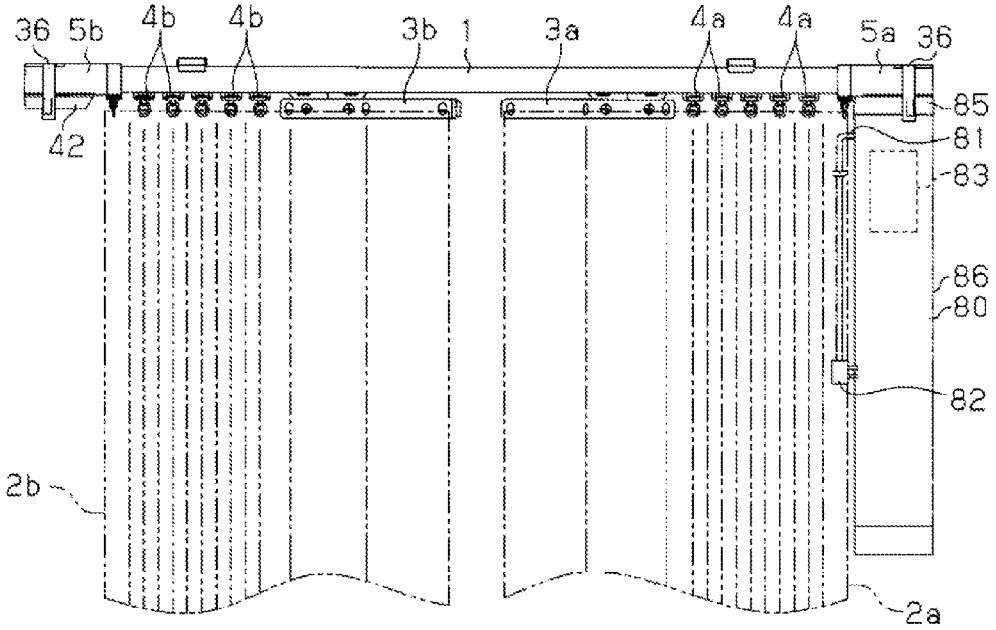
FIG. 2 is a diagram showing a schematic configuration of the solar shading device in which an electric drive unit is attached to the carrying mechanism.

As shown in FIG. 2, if the user selects electric drive mode to drive the carrying mechanisms 5*a*, 5*b*, the user suspends an electric drive unit 80, in place of the manual drive unit 50, from the carrying mechanism 5*a* in such a manner that the electric drive unit 80 is supported by the carrying mechanism 5*a*. The electric drive unit 80 is a electric drive mechanism detachable from the carrying mechanism 5*a*. In the case of the electric drive unit 80, a power supply cord 81 extends from a unit case 86 that houses a motor 83. The power supply cord 81 has a plug 82 on an end thereof. When the plug 82 is inserted into a receptacle (not shown), power is supplied to the motor 83. When the user operates an operation button (not shown), the electric drive unit 80 drives the motor 83 to move the leading runners 3*a*, 3*b* in a direction corresponding to that operation. One of a first operation unit and a second operation unit is the manual drive unit 50, and the other is the electric drive unit 80.

Referring to FIGS. 3 to 8, the carrying mechanism 5*a* will be described. The carrying mechanisms 5*a*, 5*b* have the same configuration. The carrying mechanism 5*a* is disposed at the right end of the curtain rail 1, whereas the carrying mechanism 5*b* is disposed at the left end of the curtain rail 1. Hereafter, the carrying mechanism 5*a* will be described in detail, and the carrying mechanism 5*b* will not be described.

Figure 3:
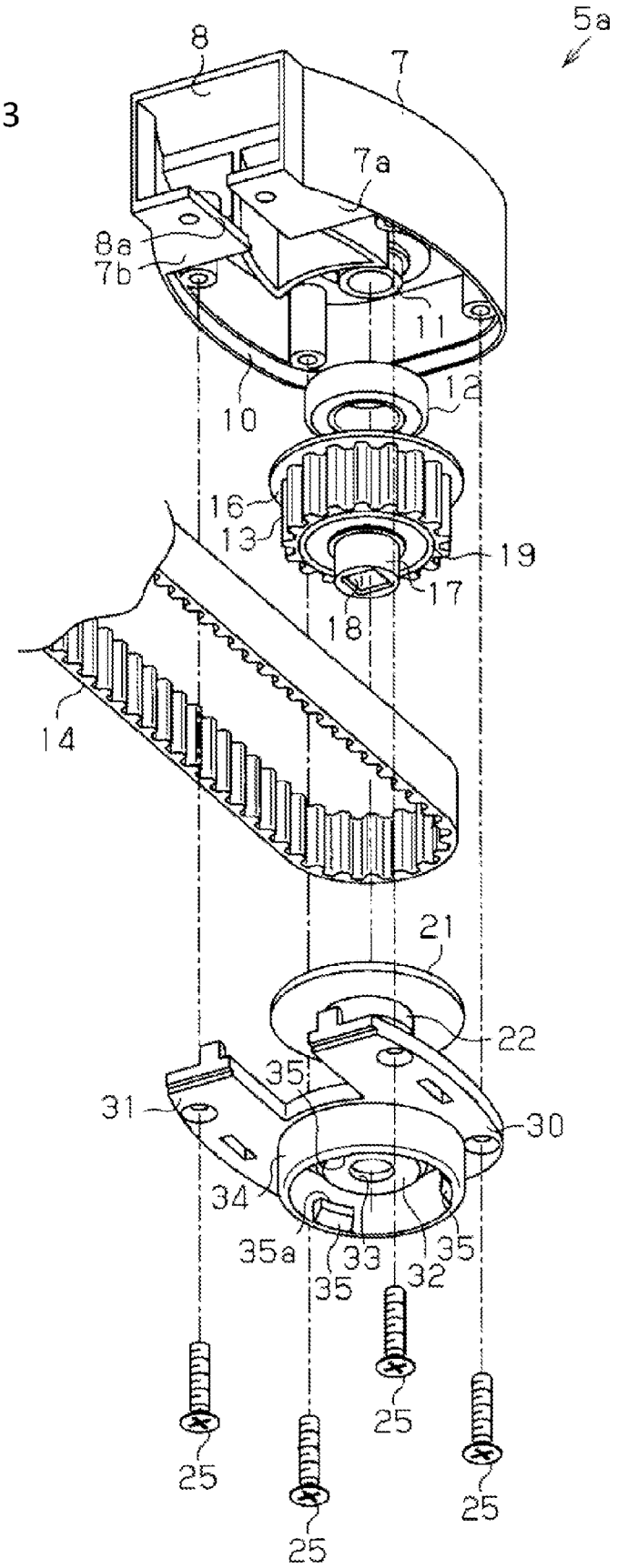
FIG. 3 is an exploded perspective view showing the carrying mechanism.
Figure 4:
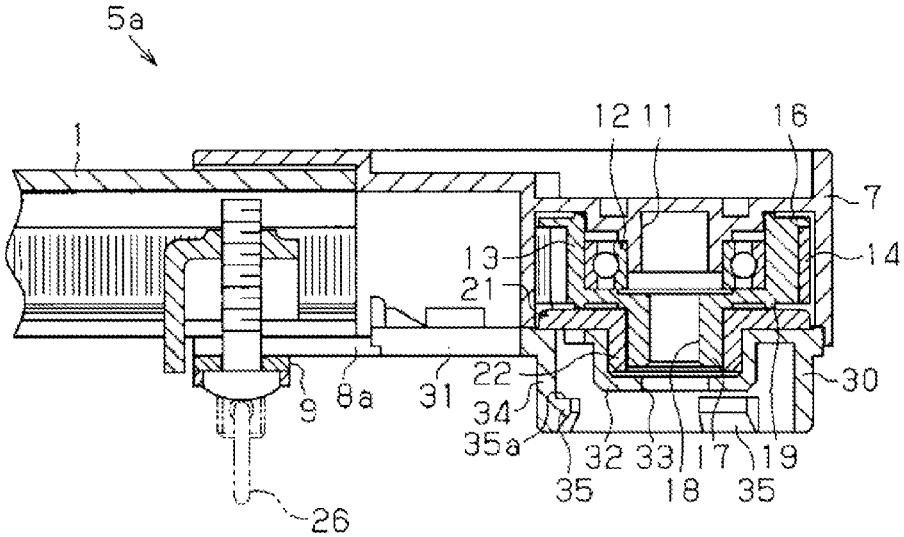
FIG. 4 is a sectional view showing the carrying mechanism.
Figure 5:
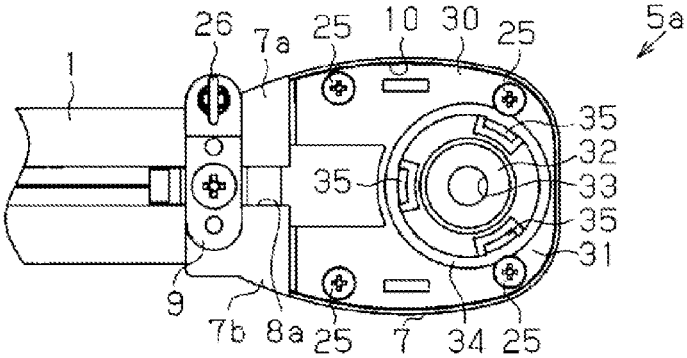
FIG. 5 is a bottom view showing the carrying mechanism.

As shown in FIGS. 3 to 5, a case 7 of the carrying mechanism 5*a* is formed in an approximately rectangular box shape whose width and height are slightly larger than those of the curtain rail 1 in the front-back direction of the curtain. A pair of side surfaces opposed to each other in the front-back direction, of the case 7 are curved surfaces which are swelled slightly in the front-back direction.

The case 7 has, in the base end thereof, a fitting port 8 into which the curtain rail 1 can be fitted. The case 7 also has, in the lower surface thereof, a mounting groove 8*a* formed by a pair of pressing pieces 7*a*, 7*b*. The curtain rail 1 is fitted in the fitting port 8, and the case 7 is fixed to the curtain rail 1 using a fixture 9 mounted in the mounting groove 8*a* (see FIGS. 4 and 5). The pair of pressing pieces 7*a*, 7*b* serve as pressing parts, and the mounting groove 8*a* serves as an engaging port.

The case 7 has a downward opening 10 in the lower surface thereof. The opening 10 is a portion of the lower surface except for the base end, on which the fixture 9 is mounted. A cylindrical shaft 11 protrudes downward from the midsection of the inner upper surface of the case 7. A circular bearing 12 is fitted in the outer circumferential surface of the shaft 11.

A cylindrical carrying pulley 13 (hereafter simply referred to as "pulley 13") is fitted in the outer circumferential surface of the bearing 12. The pulley 13 is rotatably supported by the shaft 11 through the bearing 12. The outer circumferential surface of the pulley 13 is formed in a gear shape, and a carrying belt 14 formed of a synthetic resin and serving as a carrying member is hung on the outer circumferential surface.

The carrying belt 14 is an endless belt that moves within the curtain rail 1 on the basis of an operation of the operation unit attached to the carrying mechanism 5*a*. The carrying belt 14 consists of a timing belt which is engaged with the pulley 13. Thus, when the pulley 13 rotates, the carrying belt 14 moves within the curtain rail 1.

The pulley 13 has, on the upper edge thereof, a flange 16 having a slightly larger diameter than the maximum diameter of the gear of the pulley 13. The flange 16 controls the displacement of the carrying belt 14 hung on the pulley 13 in the axially upward direction of the pulley 13.

The pulley 13 has a downward extending input shaft 17 in the midsection thereof. The input shaft 17 has a rectangular shaft insertion hole 18 in the midsection thereof. For the carrying mechanism 5*a*, the drive shaft of the operation unit is fitted in the shaft insertion hole 18; for the carrying mechanism 5*b*, nothing is connected to the shaft insertion hole 18.

A circular ridge 19 whose rotation center is the rotation center of the pulley 13 is formed on the outer circumferential surface of the input shaft 17 of the pulley 13, that is, on the surface thereof opposed to a sleeve 21. The ridge 19 is formed with a semi-circular section. A case lid 30 is fixed to the lower surface of the case 7 using screws 25. The pulley 13 is held in the case 7. The sleeve 21 is interposed between the case lid 30 and pulley 13.

The sleeve 21 has an approximately disc shape having the same diameter as that of the flange 16. The sleeve 21 has, in the midsection thereof, a tubular part 22 into which the input shaft 17 of the pulley 13 can be inserted. When the input shaft 17 is inserted into the tubular part 22 of the sleeve 21, the tops of the ridge 19 of the pulley 13 contact the sleeve 21. Thus, the friction resistance between the pulley 13 and sleeve 21 is reduced, so that the pulley 13 rotates smoothly.

The case lid 30 includes a base plate 31 fixed to the case 7. The base plate 31 has, in the midsection thereof, a bottomed, cylindrical insertion part 32 into which the tubular part 22 of the sleeve 21 can be inserted. The insertion part 32 has, in the bottom thereof, a circular insertion hole 33 that has a smaller diameter than the outer diameter of the input shaft 17 and exposes the opening of the shaft insertion hole 18. The central axis of the insertion part 32 passes through the center of the insertion hole 33.

A cylindrical unit support part 34 is formed on the base plate 31 so as to surround the outer circumferential surface of the insertion part 32 and to have the same central axis as the insertion part 32. The lower edge of the unit support part 34 is disposed so as to be lower than the bottom of the insertion part 32. Inwardly protruding, nail-shaped three suspension/support parts 35 are formed on the inner circumferential surface of the lower edge of the unit support part 34 at predetermined intervals in the direction of a circumference about the central axis of the insertion part 32. Each suspension/support part 35 has a flat support surface 35*a*, and the manual drive unit 50 or electric drive unit 80 is suspended from and supported by the support surfaces 35*a*. The pair of pressing pieces 7*a*, 7*b* and suspension/support parts 35 constitute a suspension part.

When the bearing 12, pulley 13, carrying belt 14, and sleeve 21 are stored in the case 7 and then the case lid 30 is mounted on the case 7 using the screws 25, the pulley 13 having the carrying belt 14 hung thereon is rotatably supported in the case 7. A fixing ring 26 which is immovably fixed to the end of the curtain rail 1 is mounted on the fixture 9. The upper-rear edge of the fabric curtain 2*a* is suspended from and supported by the fixing ring 26.

Figure 6:
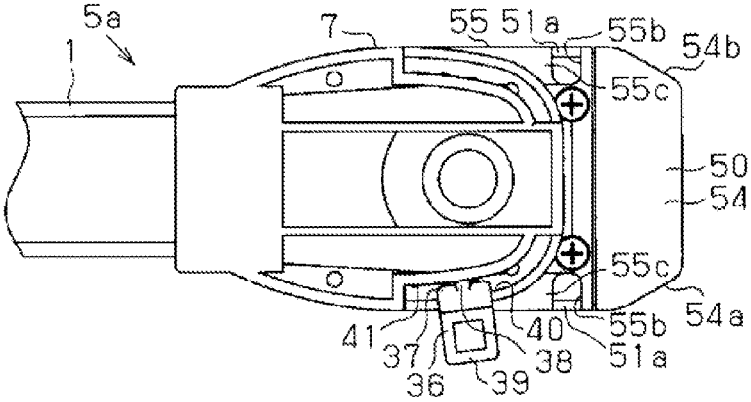
FIG. 6 is a top view showing the carrying mechanism having a hook mounted thereon.
Figure 7:
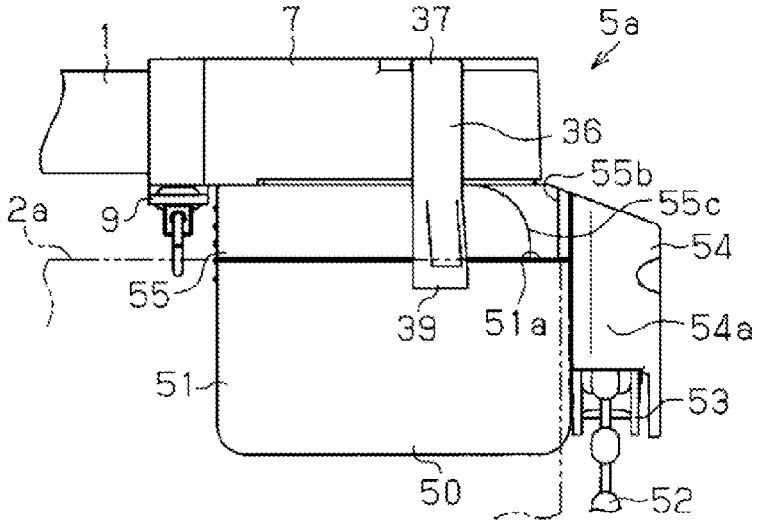
FIG. 7 is a front view showing the carrying mechanism having the hook mounted thereon.

As shown in FIGS. 6 and 7, a hook 36 is hung on the upper surface of the front end of the case 7. The hook 36 is formed of a synthetic resin and in a tabular shape and includes a hooking piece 37 having a crank shape extending from the upper end backward. The hooking piece 37 has, in the horizontal center of the rear surface thereof, a vertically extending ridge 38.

The hook 36 has, on the lower end thereof, a protrusion whose left and right sides protrude forward. The hook 36 also has, on the lower end thereof, a rectangular frame-shaped suspension part 39 having the front end of the protrusion coupled thereto. The rear edge of the fabric curtain 2*a* can be suspended from the suspension part 39.

The case 7 has, in the upper surface of the front end thereof, a hooking groove 40 on which the hooking piece 37 of the hook 36 can be hung from above. The hooking groove 40 has, in the side surface thereof opposed to the ridge 38 of the hooking piece 37, equally spaced multiple protrusions 41 between which the ridge 38 can be inserted.

The user selects one of multiple attachment positions of each of the carrying mechanisms 5*a*, 5*b* and attaches the hook 36 to the selected attachment position. Thus, the hook 36 is attached to the case 7, and the upper-rear edge of the fabric curtain 2*a* is suspended from and supported by the hook 36.

Figure 8:
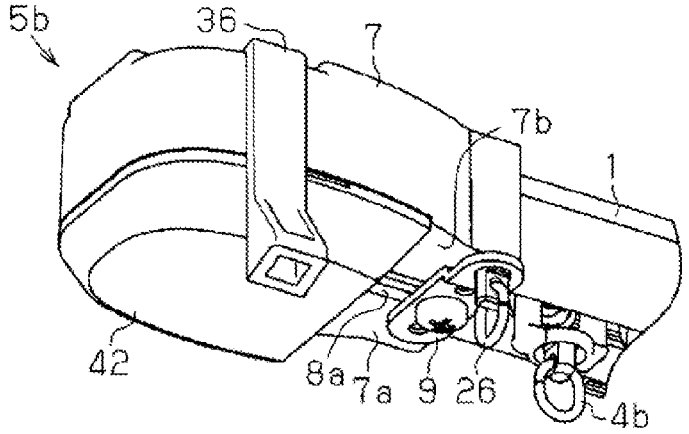
FIG. 8 is a perspective view showing the carrying mechanism having a cover mounted thereon.

As shown in FIG. 8, with regard to the carrying mechanism 5*b*, to which an operation unit is not attached, a cover 42 for covering an opening 10 is mounted thereon and covers a shaft insertion hole 18 of a pulley 13.

Referring to FIGS. 9 to 14, the manual drive unit 50 will be described.

Figure 9:
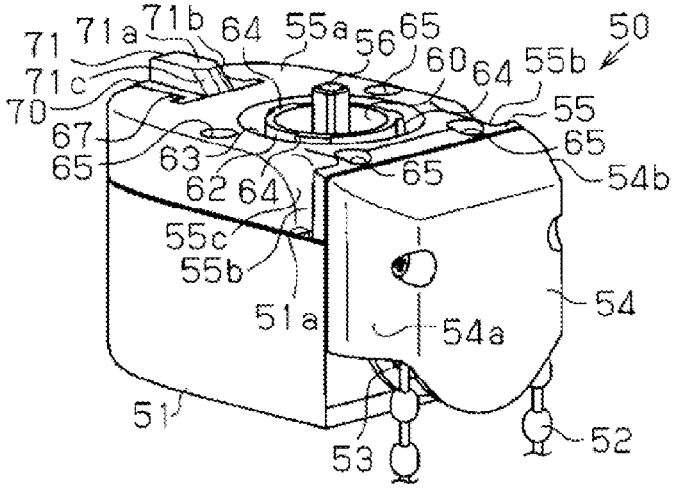
FIG. 9 is a perspective view showing the manual drive unit.

As shown in FIG. 9, a unit case 51 of the manual drive unit 50 contains a transmission mechanism (not shown). The transmission mechanism includes a drive pulley 53 having the manual operation cord 52 hung thereon. The drive pulley 53 is housed in a housing case 54 mounted on an end surface of the unit case 51. The housing case 54 has a pair of notched surfaces 54*a*, 54*b* obtained by notching vertically extending corners. The pair of notched surfaces 54*a*, 54*b* are formed so as to be symmetrical with each other. The portions of the housing case 54 more distant from the unit case 51 and a unit cap 55 have smaller widths in the front-back direction.

The unit cap 55 is mounted on the upper side of the unit case 51 so as to be detachable from the carrying mechanism 5*a*. The unit cap 55 has a drive shaft 56 protruding therefrom. The drive shaft 56 has a rectangular section and is inserted in the shaft insertion hole 18 of the pulley 13. The drive shaft 56 is coupled to the transmission mechanism in the unit case and rotates on the basis of an operation of the manual operation cord 52.

The manual drive unit 50 includes a stopper 70 that can protrude or retreat from the upper surface 55*a* of the unit cap 55. When a rotation prevention part 71 is engaged into the mounting groove 8*a* of the case 7, the stopper 70 regulates the rotation of the manual drive unit 50 about the drive shaft 56.

Figure 10:
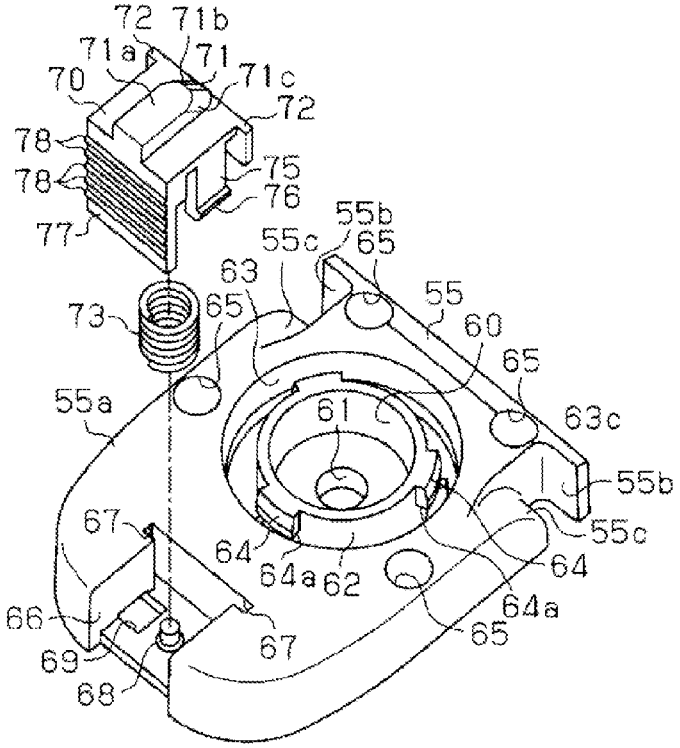
FIG. 10 is an exploded perspective view showing a unit cap and a stopper of the manual drive unit.
Figure 11:
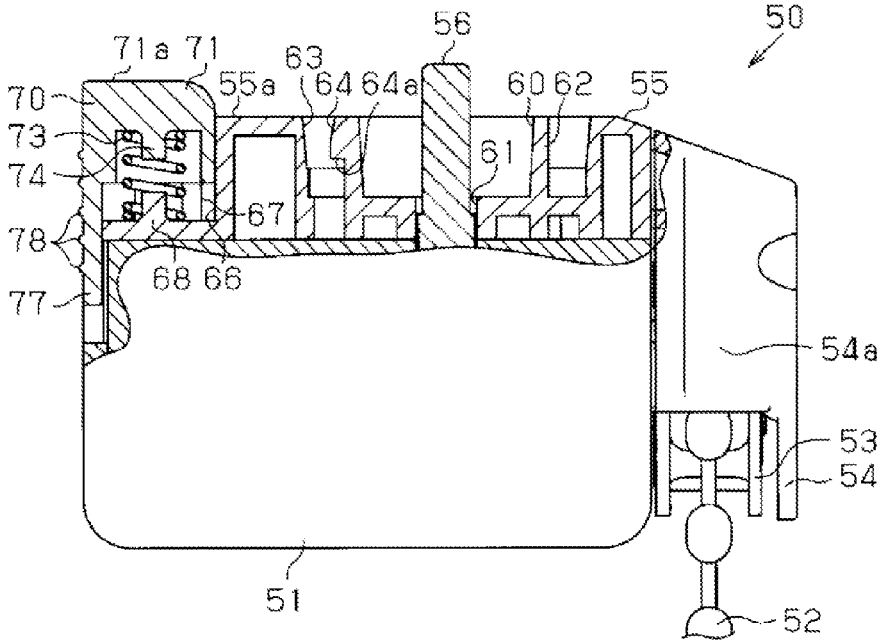
FIG. 11 is a sectional view showing the unit cap and its vicinity of the manual drive unit.

As shown in FIGS. 10 and 11, in a state in which the unit cap 55 is mounted on the carrying mechanism 5*a*, the lower-left portion thereof in FIG. 10 is disposed near the curtain rail 1. The unit cap 55 has, in the midsection thereof, a circular insertion recess 60 into which the insertion part 32 of the case lid 30 can be inserted. The insertion recess 60 has, in the bottom thereof, a circular through hole 61 about the central axis of the insertion recess 60 and has the drive shaft 56 passed through the through hole 61.

The unit cap 55 also has a circular insertion groove 63 that surrounds a circumferential wall 62 of the insertion recess 60 and has the same central axis as the insertion recess 60. The insertion groove 63 is formed such that the unit support part 34 of the case lid 30 can be inserted thereinto. The circumferential wall 62 of the insertion recess 60 has, in the outer circumferential surface thereof, nail-shaped hooks 64 that are hung on the suspension/support parts 35 of the unit support part 34. Each hook 64 has a flat hooking surface 64*a* (see FIG. 11).

Four bolt insertion holes 65 are formed around the insertion groove 63. Bolts are screwed into female screws of the unit case 51 through the bolt insertion holes 65 and thus the unit cap 55 is fixed to the unit case 51.

The unit cap 55 has, on both sides of the insertion groove 63 in the front-back direction, a pair of relief grooves 55*b* that are open toward the upper surface 55*a*, the lower surface, and the side surfaces of the unit cap 55. As shown in FIG. 6, the relief grooves 55*b* are formed in portions of the unit cap 55 that are not opposed to the carrying mechanism 5*a* in the vertical direction with the manual drive unit 50 attached to the carrying mechanism 5*a*. Thus, the relief grooves 55*b* expose the upper edge 51*a* of the circumferential wall of the unit case 51. As with the fixing ring 26, hooks attached to the fabric curtain 2*a* is hung on the upper edge 51*a* and thus the fabric curtain 2*a* is suspended from and supported by the upper edge 51*a*. Accordingly, the unit case 51 can be covered with the fabric curtain 2*a*. As shown in FIG. 7, the unit cap 55 is formed such that the fabric curtain 2*a* is suspended from and supported by the fixing ring 26 and upper edge 51*a* at the same height.

If the user hangs the hooks attached to the fabric curtain 2*a* on the upper edge 51*a* and then the hook extends off over the carrying mechanism 5*a*, a space corresponding to the extension would be required over the carrying mechanism 5*a*. For this reason, each relief groove 55*b* has a curved guide surface 55*c* so that the opening in the lower surface is smaller than the opening in the upper surface 55*a*. Thus, the user can hang the hook on the upper edge 51*a* by inserting the hooks attached to the fabric curtain 2*a* into the relief grooves 55*b* along the guide surfaces 55*c* from diagonally above. That is, the guide surfaces 55*c* allow the user to hang the hooks of the fabric curtain 2*a* on the upper edge 51*a* even when the space over the upper edge is small.

A stopper housing part 66 is formed in the midsection in the front-back direction, of the end of the unit cap 55 near the curtain rail 1. The stopper housing part 66 is open toward the upper surface 55*a* and a side surface of the unit cap 55 and houses the stopper 70.

The stopper housing part 66 has a pair of vertically extending guide grooves 67. The stopper 70 has a pair of guide pieces 72. When the guide pieces 72 are guided by the guide grooves 67, the stopper 70 moves along the vertical direction.

The stopper 70 is energized upward toward the unit cap 55 by an energizing spring 73, which is a compression spring. The stopper housing part 66 has, on the bottom thereof, a lower end holding part 68 that holds the lower end of the energizing spring 73. As shown in FIG. 11, the stopper 70 has an upper end holding part 74 that holds the upper end of the energizing spring 73.

The stopper housing part 66 has, in the bottom thereof, a pair of engaging holes 69 formed on both sides in the front-back direction, of the lower end holding part 68. The stopper 70 includes a pair of snap-engaging parts 75 that are snap-engaged in the pair of engaging holes 69. Note that FIG. 10 shows an engaging hole 69 and a snap-engaging part 75 that are not engaged with each other. Each snap-engaging part 75 has, on the lower end thereof, an upward movement regulating piece 76 that protrudes outward. When the snap-engaging parts 75 are engaged with the engaging holes 69, the upward movement regulating pieces 76 are caught on the opening edges of the engaging holes 69. Thus, the upward movement of the stopper 70 based on the energizing force of the energizing spring 73 is regulated.

The stopper 70 includes the rotation prevention part 71 that protrudes from the upper surface 55*a* of the unit cap 55 with the upward movement regulated. The rotation prevention part 71 has a flat upper surface 71*a*. When the rotation prevention part 71 is engaged into the mounting groove 8*a* of the case 7, the rotation prevention part 71 regulates the rotation of the manual drive unit 50 about the drive shaft 56. The rotation prevention part 71 has, on the edge thereof opposite to an operation part 77 (to be discussed later), a pair of tapered surfaces 71*b*, 71*c* that are obtained by partially notching the rotation prevention part 71 and inclined from the upper surface 71*a* outward.

The stopper 70 *includes the operation part 77 that extends from the edge near the curtain rail 1, of the rotation prevention part 71 downward. The lower edge of the operation part 77 is located below the lower surface of the unit cap 55 so that the energizing spring 73 is covered by the operation part 77. The operation part 77 has multiple ridges 78 formed thereon. The ridges 78 have semi-circular sections and extend in the front-back direction.

The formation of the ridges 78 increases the friction resistance, allowing the user to easily operate the operation part 77.

Figure 12:
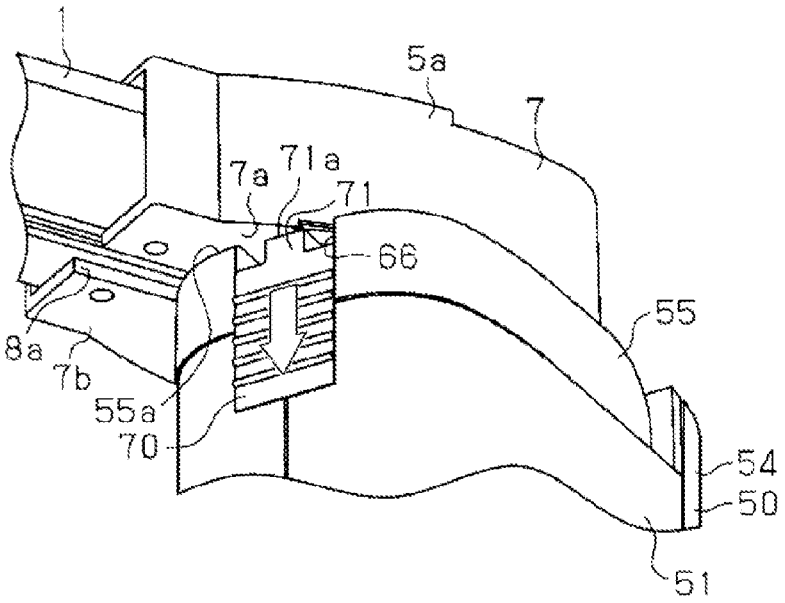
FIG. 12 is a perspective view showing a state in which the manual drive unit is disposed in an attachment/detachment position.
Figure 13:
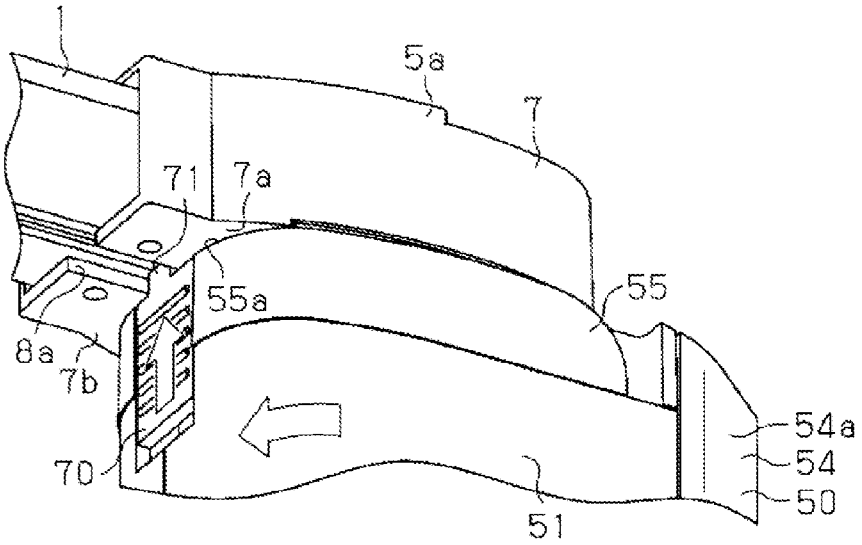
FIG. 13 is a perspective view showing a state in which the manual drive unit is disposed in a suspension position.

Referring to FIGS. 12 and 13, a method for mounting and demounting the manual drive unit 50 on and from the carrying mechanism 5*a* will be described. Note that in FIGS. 12 and 13, the fixture 9 or fixing ring 26 is not shown.

As shown in FIG. 12, in order to mount the manual drive unit 50, first, the drive shaft 56 of the manual drive unit 50 is inserted into the shaft insertion hole 18 of the pulley 13. Then, with the drive shaft 56 inserted in the shaft insertion hole 18, the manual drive unit 50 is rotated about the drive shaft 56 to a attachment/detachment position, which is a position in which the suspension/support parts 35 of the case lid 30 and the hooks 64 of the unit cap 55 do not vertically overlap each other. Then, the manual drive unit 50 is lifted. Thus, the unit support part 34 of the case lid 30 is inserted into the insertion groove 63 of the unit cap 55.

If the upper surface 71*a* of the rotation prevention part 71 contacts the pressing piece 7*a*, the stopper 70 is pressed by the pressing piece 7*a* and thus moved downward against the energizing force of the energizing spring 73. On the other hand, if the upper surface 71*a* of the rotation prevention part 71 does not contact the pressing piece 7*a*, the tapered surface 71*b* is pressed by the outer edge of the pressing piece 7*a* in the middle of the rotation of the manual drive unit 50 from the attachment/detachment position to a suspension position (to be discussed later). Thus, the stopper 70 is moved downward. Or, the tapered surface 71*c* is pressed by the outer edge of the pressing piece 7*b* and thus the stopper 70 is moved downward. Since the tapered surfaces 71*b*, 71*c* are disposed, the stopper 70 is easily moved downward due to the rotation of the manual drive unit 50 even when the user does not operate the operation part 77. The stopper 70, which has been moved downward, is housed in the stopper housing part 66 of the unit cap 55 and thus the rotation prevention part 71 retracts into the unit cap 55.

Then, as shown in FIG. 13, the manual drive unit 50 is rotated about the drive shaft 56 so that the rotation prevention part 71 is engaged into the mounting groove 8*a*. Then, the stopper 70 is moved upward by the energizing force of the energizing spring 73 and thus the manual drive unit 50 is disposed in the suspension position in which the rotation prevention part 71 is engaged into the mounting groove 8*a*.

Figure 14:
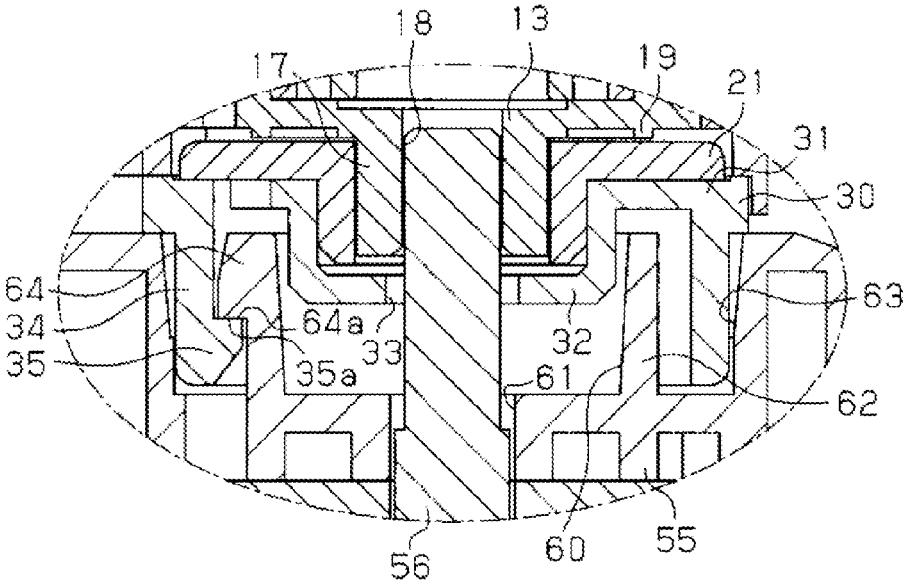
FIG. 14 is a diagram showing a state in which the manual drive unit is disposed in the suspension position and is a sectional view showing a state in which hooks of the unit cap are hung on suspension/support parts of a case lid.

As shown in FIG. 14, when the manual drive unit 50 lies in the suspension position, the hooks 64 of the unit cap 55 are hung on the suspension/support parts 35 of the unit support part 34 of the case lid 30. Thus, the manual drive unit 50 is suspended from the carrying mechanism 5*a* while being prevented from rotating about the drive shaft 56.

Conversely, in order to demount the manual drive unit 50 from the carrying mechanism 5*a*, first, the operation part 77 of the stopper 70 is operated to move the stopper 70 downward, causing the rotation prevention part 71 to retract into the unit cap 55. Thus, the manual drive unit 50 is made rotatable about the drive shaft 56. Then, with the rotation prevention part 71 retracting in the unit cap 55, the manual drive unit 50 is rotated about the drive shaft 56. After the manual drive unit 50 is rotated to the attachment/detachment position, the manual drive unit 50 is lowered. In this way, the manual drive unit 50 is demounted from the carrying mechanism 5*a*.

Figure 15:
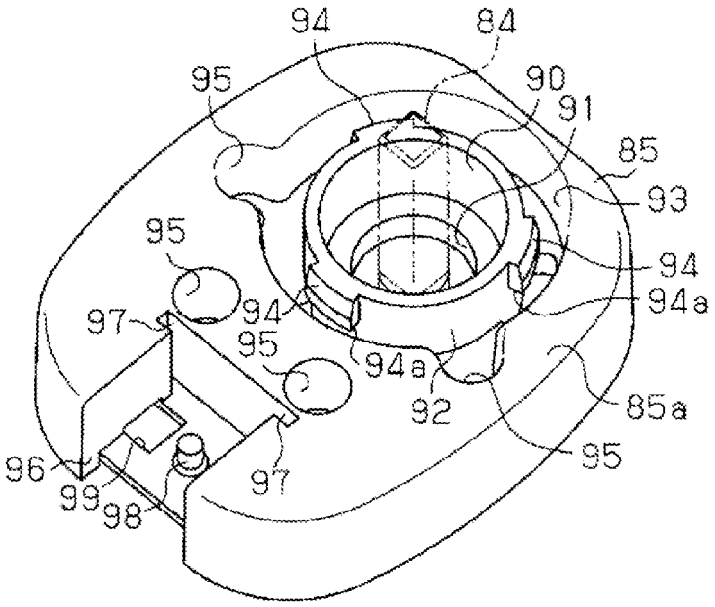
FIG. 15 is an exploded perspective view showing a unit cap of the electric drive unit.

Referring to FIG. 15, a unit cap 85 of the electric drive unit 80 will be described. The unit cap 85 is detachably attached to the unit case 51 of the electric drive unit 80. The unit cap 85 has the same basic structure as the unit cap 55 of the manual drive unit 50. For this reason, portions having the same functions are given names similar to those of the unit cap 55 in the description below.

As shown in FIG. 15, the unit cap 85 has, in the midsection thereof, a circular insertion recess 90 into which the insertion part 32 of the case lid 30 can be inserted. The insertion recess 90 has, in the bottom thereof, a circular through hole 91 around the insertion recess 90 and has a drive shaft 84 passed through the through hole 91. The drive shaft 84 is formed with the same rectangular section as that of the drive shaft 56. The drive shaft 84 is rotationally driven by the motor 83. The unit cap 85 also has a circular insertion groove 93 that surrounds a circumferential wall 92 of the insertion recess 90 and has the same central axis as the insertion recess 90. The circumferential wall 92 of the insertion recess 90 has three hooks 94 on the outer circumferential surface thereof. Each hook 94 has a flat hooking surface 94*a*. The unit cap 85 has a stopper housing part 96 that houses the stopper 70 and energizing spring 73. The stopper housing part 96 has guide grooves 97, a lower end holding part 98, and an engaging hole 99. The unit cap 85 is fixed to the unit case 86 by bolts inserted in four bolt insertion holes 95 formed around the insertion groove 93.

Next, functions of the solar shading device will be described.

In the solar shading device, one of the manual drive unit 50 and electric drive unit 80 is attached to the carrying mechanism 5*a*, and both the manual drive unit 50 and electric drive unit 80 are detachable from the carrying mechanism 5*a*. Thus, the user can select an operation unit corresponding to the desired drive mode. The manual drive unit 50 includes the drive shaft 56 that is coupled to the pulley 13 and drives the pulley 13 and the manual operation cord 52 for driving the drive shaft 56. On the other hand, the electric drive unit 80 includes the drive shaft 84 that is coupled to the pulley 13 and drives the pulley 13, the motor 83 for driving the drive shaft 84, and the power supply cord 81 that supplies power to the motor 83. Thus, if the user wants to drive the carrying mechanisms 5*a*, 5*b* in manual drive mode, the carrying mechanisms 5*a*, 5*b* are driven with a configuration from which the motor 83 and power supply cord 81 are removed. On the other hand, if the user wants to drive the carrying mechanisms 5*a*, 5*b* in electric drive mode, the carrying mechanisms 5*a*, 5*b* are driven with a configuration from which the operation cord 52 is removed. That is, when the user uses the solar shading device in which the drive mode of the carrying mechanisms 5*a*, 5*b* is switched between manual and electric drive modes, the user can change the apparatus configuration to that suitable for the desired drive mode.

The above solar shading device can produce the following advantageous effects.

(1) The manual drive unit 50 or electric drive unit 80 can be attached to the carrying mechanism 5*a*. Thus, a solar shading device suitable for the drive mode desired by the user can be provided.

(2) Only a solar shading device in which the manual drive unit 50 is attached to the carrying mechanism 5*a* is provided with the manual operation cord 52. Thus, the operation button for driving the motor 83 of the electric drive unit 80 can be freely disposed without having to consider the length or position of the manual operation cord 52. Further, the manual drive unit 50 is not provided with a motor or the like, unlike an operation unit for both manual drive mode and electric drive mode. That is, the spaces occupied by the operation units become spaces corresponding to the drive modes desired by the user.

(3) Since both the manual drive unit 50 and electric drive unit 80 are detachable from the carrying mechanism 5*a*, the operation unit can be changed to another.

(4) The manual drive unit 50 is attached to the carrying mechanism 5*a* by rotating it about the drive shaft 56 with the drive shaft 56 inserted in the shaft insertion hole 18 of the pulley 13 and with the unit support part 34 of the case lid 30 inserted in the insertion groove 63.

For this reason, the manual drive unit 50 can be detached from the carrying mechanism 5*a* by rotating it about the drive shaft 56 with the stopper 70 and mounting groove 8*a* disengaged from each other. This also applies to the electric drive unit 80.

(5) The manual drive unit 50 includes the stopper 70 that prevents an operation unit attached to the carrying mechanism 5*a* from rotating about the drive shaft 56. The stopper 70 is energized upward by the energizing spring 73. In attaching the operation unit to the carrying mechanism 5*a*, the stopper 70 is pressed by the pressing piece 7*a* of the case 7 and thus retracts into the unit cap 55, and then protrudes again and is engaged into the mounting groove 8*a*.

Thus, it is possible to prevent the operation unit from rotating due to the rotation of the drive shaft 56, as well as to attach the operation unit to the carrying mechanism 5*a* without having to operate the stopper 70. This also applies to the electric drive unit 80.

(6) Both the support surfaces 35*a* and hooking surfaces 64*a* are flat. Thus, when the user rotates the operation unit between the suspension position and the attachment/detachment position, the user may rotate the operation unit in any direction. That is, the user may attach or detach the operation unit in the desired rotation direction.

(7) The drive shaft 56 and drive shaft 84 are formed so as to have the same rectangular section. Thus, for example, there is no need to form a key groove in the inner circumferential surface of the shaft insertion hole 18, which can simplify the structure of the shaft insertion hole 18.

(8) The moving direction of the stopper 70 is vertical, and the energizing spring 73 is a compression spring. Thus, the energizing spring can be disposed in a space which vertically overlaps the stopper 70. This prevents the upsizing of the manual drive unit 50 in directions other than the vertical direction resulting from the stopper 70 and energizing spring 73. As a result, the radius of the rotation of the manual drive unit 50 about the drive shaft 56 is reduced, and the space occupied by the solar shading device having the manual drive unit 50 attached thereto is reduced. Thus, for example, there is prevented the upsizing of a curtain box housing the curtain rail 1, carrying mechanisms 5*a*, 5*b*, and manual drive unit 50.

(9) The carrying mechanism 5*a* is only required to have the engaging port into which the upward moving rotation prevention part 71 is engaged. This prevents the upsizing of the carrying mechanism 5*a* in directions other than the vertical direction resulting from the formation of the engaging port.

(10) The housing case 54 has the pair of notched surfaces 54*a*, 54*b* obtained by notching vertically extending corners. Due to the pair of notched surfaces 54*a*, 54*b*, portions more distant from the unit case 51 and unit cap 55, of the housing case 54 have smaller widths in the front-back direction. According to this configuration, the radius of the rotation of the housing case 54 about the drive shaft 56, that is, the radius of the rotation of the manual drive unit 50 can be reduced. Thus, the curtain rail 1 can be disposed in a position closer to the wall surface. As a result, it is possible to increase the degree of freedom of the installation position of the curtain rail 1 and thus the degree of freedom of the installation position of the solar shading device.

The above embodiment may be carried out in the following forms.

The drive shaft may be coupled to the pulley 13 through a key formed on the drive shaft and a key groove formed in the inner circumferential surface of the shaft insertion hole. The drive shaft 56 of the manual drive unit 50 and the drive shaft 84 of the electric drive unit 80 may have different shapes.

The suspension/support parts 35 may have, for example, recesses into which the hooks 64, 94 are engaged in the suspension position, and the rotation of the operation unit about the drive axis may be prevented by engaging the hooks 64, 94 into the recesses. In this configuration, the stopper 70 and elements related to the stopper 70, such as the energizing spring 73, may be omitted.

If the suspension/support parts 35 have the above recesses, the operation unit may be suspended from the carrying mechanism, for example, by snap-engaging the hooks 64, 94 with the suspension/support parts 35.

One of the manual drive unit 50 and electric drive unit 80 may be undetachable from the carrying mechanism 5*a*.

Figure 16:
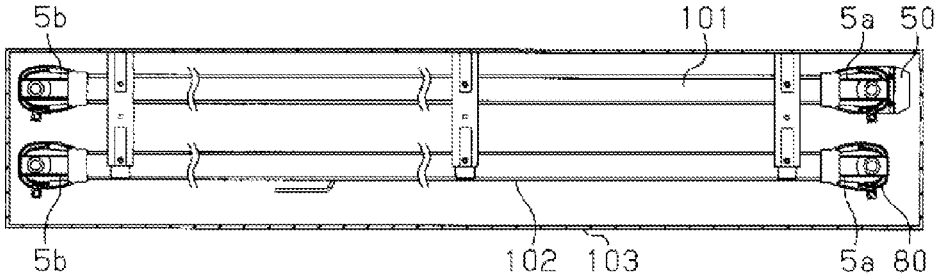
FIG. 16 is a top view of a solar shading device of a modification.
Figure 17:
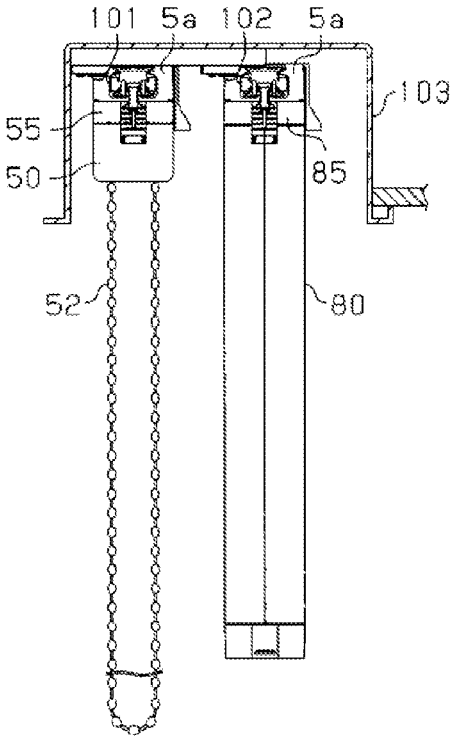
FIG. 17 is a side view of the solar shading device of the modification.

As shown in FIGS. 16 and 17, in a solar shading device including a pair of curtain rails 101, 102, a manual drive unit 50 may be attached to a carrying mechanism 5*a* of the curtain rail 101, and an electric drive unit 80 may be attached to a carrying mechanism 5*a* of the curtain rail 102. That is, in a solar shading device including multiple curtain rails, a manual drive unit 50 and an electric drive unit 80 may be selectively attached to the carrying mechanisms of the different curtain rails. According to this configuration, for example, it is possible to move an inner thick curtain electrically and to move an outer thin lace curtain manually. Note that the curtain rails 101, 102 may be housed in a curtain a box 103.

The carrying member need not be a belt-shaped member, such as the carrying belt 14, and may be a string-shaped member that moves with the rotation of the carrying pulley, or may be a stick-shaped member that expands or contracts with the rotation.

A mechanism for moving a stick-shaped carrying member may be, for example, a rack and pinion mechanism using the carrying pulley 13 as a pinion or a mechanism using a feed screw.

DESCRIPTION OF REFERENCE SIGNS

1 . . . curtain rail, 2*a*,2*b* . . . fabric curtain, 3*a*,3*b* . . . leading runner, 4*a*,4*b* . . . runner, 5*a*,5*b* . . . carrying mechanism, 7 . . . case, 7*a*,7*b* . . . pressing piece, 8 . . . fitting port, 8*a* . . . mounting groove, 9 . . . fixture, 10 . . . opening, 11 . . . shaft, 12 . . . bearing, 13 . . . carrying pulley, 14 . . . carrying belt, 15 . . . guide wall, 16 . . . flange, 17 . . . input shaft, 18 . . . shaft insertion hole 18, 19 . . . ridge, 21 . . . sleeve, 22 . . . tubular part, 25 . . . screw, 26 . . . fixing ring, 30 . . . case lid, 31 . . . base plate, 32 . . . insertion part, 33 . . . insertion hole, 34 . . . unit support part 34, 35 . . . suspension/support part, 35*a* . . . support surface, 36 . . . hook, 37 . . . hooking piece, 38 . . . ridge, 39 . . . suspension part, 40 . . . hooking groove, 41 . . . protrusion, 42 . . . cover, 50 . . . manual drive unit, 51 . . . unit case, 51*a* . . . upper edge, 52 . . . manual operation cord, 53 . . . drive pulley, 54 . . . housing case, 54*a*,54*b* . . . notched surface, 55 . . . unit cap, 55*a* . . . upper surface, 55*b* . . . relief groove, 55*c* . . . guide surface, 56 . . . drive shaft, 61 . . . through hole, 62 . . . circumferential wall, 63 . . . insertion groove, 64 . . . hook, 64*a* . . . hooking surface, 65 . . . bolt insertion hole, 66 . . . stopper housing part, 67 . . . guide groove, 68 . . . lower end holding part, 69 . . . engaging hole, 70 . . . stopper, 71 . . . rotation prevention part, 71*a* . . . upper surface, 71*b*,71*c* . . . tapered surface, 72 . . . guide piece, 73 . . . energizing spring, 74 . . . upper end holding part, 75 . . . snap engaging part, 76 . . . upward movement regulating piece, 77 . . . operation part, 78 . . . ridge, 80 . . . electric drive unit, 81 . . . power supply cord, 82 . . . plug, 83 . . . motor, 84 . . . drive shaft, 85 . . . unit cap, 86 . . . unit case, 90 . . . insertion recess, 91 . . . through hole, 92 . . . circumferential wall, 93 . . . insertion groove, 94 . . . hook, 95 . . . bolt insertion hole, 96 . . . stopper housing part, 97 . . . guide groove, 98 . . . lower end holding part, 99 . . . engaging hole, 101,102 . . . curtain rail, 103 . . . curtain box

The invention claimed is:

1. A solar shading device comprising:

a head rail slidably supporting a runner to which a sunlight shielding member is attached;

a carrying mechanism comprising a carrying pulley coupled to the runner by a carrying member, the carrying mechanism being configured to carry the runner along the head rail;

a first operation unit comprising a first shaft, the first shaft configured to couple to the carrying pulley;

a second operation unit comprising a second shaft, the second shaft configured to couple to the carrying pulley a suspension part on a lower end of the carrying mechanism having one of the first operation unit or the second operation unit detachably suspended therefrom, wherein the first operation unit is a manual drive mechanism comprising a manual operation cord configured to cause the first shaft to be rotated manually, and the second operation unit is an electric drive mechanism comprising a power supply cord configured to cause the second shaft to be rotated electrically wherein the carrying pulley has a shaft insertion hole through which the first or second shaft is received, and wherein the solar shading device is configured to be switched from a manual operating mode to an electric drive mode by decoupling the first operation unit from the carrying pulley and coupling the second operation unit to the carrying pulley; and the solar shading device is configured to be switched from the electric drive mode to the manual operating mode by decoupling the second operation unit from the carrying pulley and coupling the first operation unit to the carrying pulley.

2. The solar shading device of claim 1, wherein when the first operation unit is rotated about the first shaft from a suspension position to an attached or detached position with the first shaft received through the shaft insertion hole, suspension of the first operation unit from the suspension part is released.

3. The solar shading device of claim 2, wherein the first and second operation units each comprise a unit cap suspended from the suspension part, a stopper configured to protrude from or retract into an upper surface of the unit cap, and an energizing spring, the suspension part comprises a suspension support part from which the unit cap is suspended and a pressing part configured to press the stopper so that the stopper retracts into the unit cap and having an engaging port into which the stopper is engaged when the operation unit lies in the suspension position, and with the stopper engaged in the engaging port, rotation of the operation unit about the drive shaft is prevented.

4. The solar shading device of claim 1, wherein the first and second shafts are formed with identical rectangular sections.

5. The solar shading device of claim 1, wherein the head rail comprises a plurality of head rails which are each provided with the carrying mechanism, the first operation unit is attached to the carrying mechanism on one of the head rails, and the second operation unit is attached to the carrying mechanism on another of the head rails.

* * * * *